United States Patent [19]

Rohrbacher

[11] Patent Number: 4,513,793

[45] Date of Patent: Apr. 30, 1985

[54] SECURITY WIRE FABRIC AND APPARATUS AND METHOD FOR MAKING SAME

[75] Inventor: Herbert E. Rohrbacher, Whittier, Calif.

[73] Assignee: Bergandi Manufacturing Co., Inc., South El Monte, Calif.

[21] Appl. No.: 489,540

[22] Filed: Apr. 28, 1983

[51] Int. Cl.[3] ..... B21F 21/00

[52] U.S. Cl. ..... 140/92.4; 140/92.8; 140/92.7

[58] Field of Search ..... 140/92.3, 92.4, 92.7, 140/92.8; 72/129, 131, 132; 245/4, 6

[56] References Cited

U.S. PATENT DOCUMENTS

| | | | |
|---|---|---|---|
| 2,202,442 | 5/1940 | Blashill | 140/92.6 |
| 2,843,160 | 7/1958 | Blashill | 140/92.3 |
| 3,512,760 | 5/1970 | Rohrbacher | 140/92.3 |
| 3,583,444 | 6/1971 | Roberson | 140/92.3 |
| 3,667,509 | 6/1972 | Rohrbacher | 140/92.7 |
| 4,153,081 | 5/1979 | Lemburg et al. | 140/92.7 |

FOREIGN PATENT DOCUMENTS

| | | | |
|---|---|---|---|
| 1041452 | 10/1958 | Fed. Rep. of Germany | 140/92.3 |

*Primary Examiner*—Lowell A. Larson
*Assistant Examiner*—Linda McLaughlin
*Attorney, Agent, or Firm*—Charles H. Schwartz; Ellsworth R. Roston

[57] ABSTRACT

A wire fabric and apparatus and method of making same including processing wire to produce a wire fabric of open construction and with the wire fabric formed with small openings relative to the gauge of the wire so as to form a security mesh, including coiling the wire to have small loops, cutting the coiled wire into individual lengths by cutting out a small portion of an individual loop of the coiled wire, repetitively interweaving the coiled wire before the coiled wire is cut with the coiled wire lastly cut to form the security mesh with the interweaving operation of one individual length of coiled wire at a time, and alternately shifting the coiled wire forward and backward for successive interweaving operations for providing the proper orientation for interweaving between the lengths of coiled wire before each interweaving operation.

26 Claims, 20 Drawing Figures

DIA. OF CHAIN
TOP CUT
BOTTOM CUT
18
18

88
270
330
266
274
268
328
252
254
338
264
332
334
336
326
280
272
344
340
276
296
298
346
32
256
278
258
362
302
364
300
350
392
360
310
288
358
348
312
366
342
368
290
306
314
316

364
350
348
346
352
292

252
254
294
296
256
298
304
258
302
308
300
312
310
320
314
290
306
318
316

Fig. 11
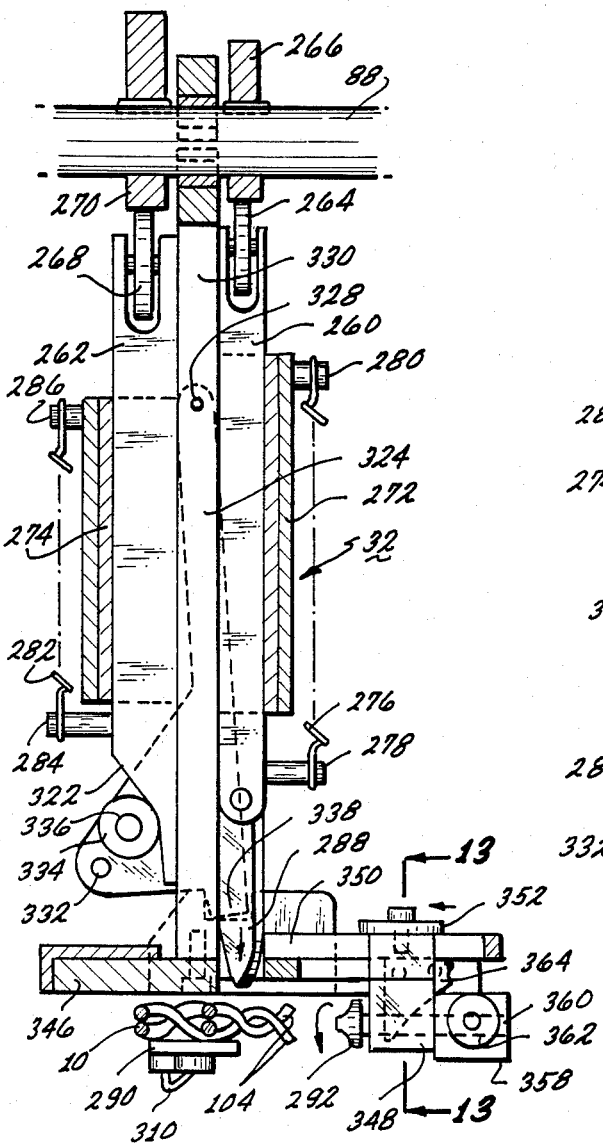
Fig. 12
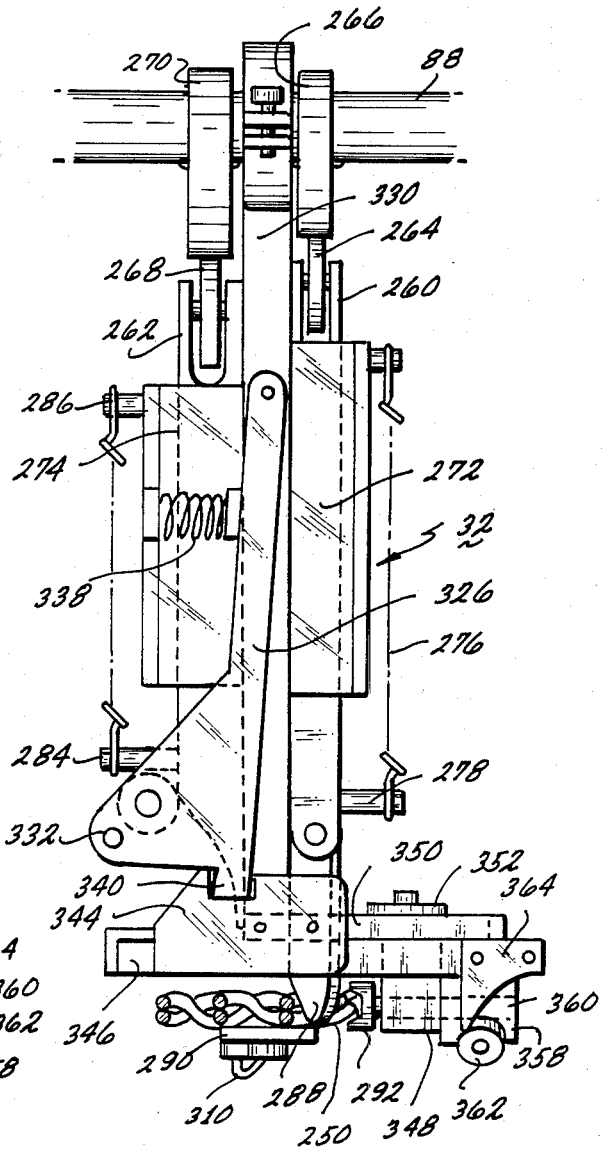
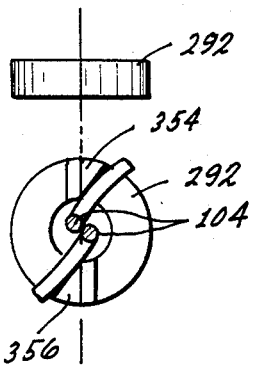
Fig. 14a
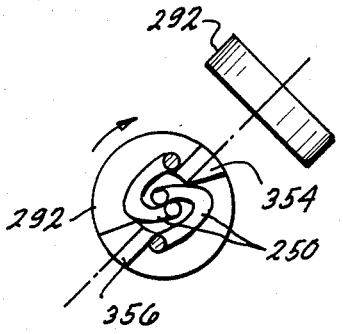
Fig. 14b

SECURITY WIRE FABRIC AND APPARATUS AND METHOD FOR MAKING SAME

BACKGROUND OF THE INVENTION

1. Field of the Invention

The present invention is directed to a security wire fabric and specifically to a chain link fabric of heavy gauge wire having closely spaced links and to an automatic apparatus and method for making such a security fabric.

2. Descripiton of the Prior Art

Wire fabric of open construction has many uses and such wire fabric is generally referred to as chain link. Chain link is generally constructed of many individual wires such as round metal wires and with each wire formed into coiled lengths of wire and with the individual coiled lengths appropriately interwoven to form the open construction wire fabric.

If the wire fabric is constructed of a relatively heavy gauge wire and with openings between adjacent wires being of a relatively small size, the fabric may be referred to as a security mesh. With this type of wire fabric the openings are generally small so as to prevent a secure fingerhold or foothold so that it is difficult if not impossible to scale the fabric. In addition, since the fabric is constructed of heavy gauge wire with small openings, the fabric is quite strong and can withstand considerable forces so as to prevent the fabric from being pulled apart.

Although it is desirable to produce a security mesh fabric as described above, heretofore such fabric has generally been constructed almost as a hand operation. In particular individual lengths of coiled wire are interwoven using considerable hand labor so as to provide for security mesh. Such prior art security mesh fabric is often not uniform in appearance since the coils may not lie perfectly entwined with each other. In addition, such prior art of security mesh has been expensive and has therefore not been readily available.

SUMMARY OF THE INVENTION

The present invention provides for a wire fabric forming a security mesh, and with such security mesh formed by automatic apparatus using a particular method of construction, and with such security mesh having end portions automatically knuckled over to produce smooth interlocked edges. The security mesh is produced by providing the coiling of individual lengths of wire and by feeding the coiled wire into weaving engagement with previous interwoven lengths of coiled wire which have been formed into the security mesh.

After each length of coiled wire is interwoven, the end of the coiled wire is cut. In order to insure that the cut ends are of suffficient length for knuckling or barbing, each end of the wire is cut to have a length greater than one-half ($\frac{1}{2}$) the distance along the wire between successive peak points of each loop of the coiled wire. In particular, after each length of coiled wire is interwoven a small portion of the wire is cut out at a peak point of the loop so as to leave adjacent cut ends greater than one-half ($\frac{1}{2}$) the distance along the wire between successive peak points of each loop. These cut ends appear along each side of the security mesh.

Before the next length of coiled wire is interwoven into the previously interwoven length of coiled wire, the entire length of coiled wire is either moved forward or moved backward a distance of approximately one-half ($\frac{1}{2}$) of the distance between successive peak points or the equivalent of a phase shift of approximately 180°. This insures that when the interweaving operation is performed, the lengths of coiled will will properly interweave with the previously interwoven length of coiled wire.

The security mesh of the present invention is thereby produced with cut ends which protrude a sufficient distance so as to allow the cut ends to be knuckled over to interlock the sides of the mesh. As a further improvement the present invention includes a unique knuckler assembly which both folds and rotates the cut ends so as to knuckle over and further interlock the ends to produce tightly interlocked sides for the security mesh.

The present invention therefore allows for the use of heavy gauge wire such as gauge wire in the range of 9 to 14 gauge generally used for large chain link to be used to produce chain link having a small mesh size. For example, the spacing between peak points of adjacent loops may be on the order of three-quarters ($\frac{3}{4}$) of an inch and with the smallest distance across the mesh opening of approximately three-eighths ($\frac{3}{8}$) of an inch. This is considerably smaller than chain link made with automatic weavers of the prior art.

BRIEF DESCRIPTION OF THE DRAWINGS

A clearer understanding of the present invention will be had with reference to the following descriptions and drawings therein:

FIGS. 11 and 12 are top views of the knuckler of FIG. 10 in two different positions of operation;

FIGS. 14*a* and 14*b* illustrate the operation of the knuckler head on the cut ends of the security mesh and correspond to the positions of operation shown in FIGS. 11 and 12 and FIG. 15 is a perspective view of a portion of the knuckler assembly for maintaining the chain link in position for knuckling.

DESCRIPTION OF THE PREFERRED EMBODIMENT

Figure 1:
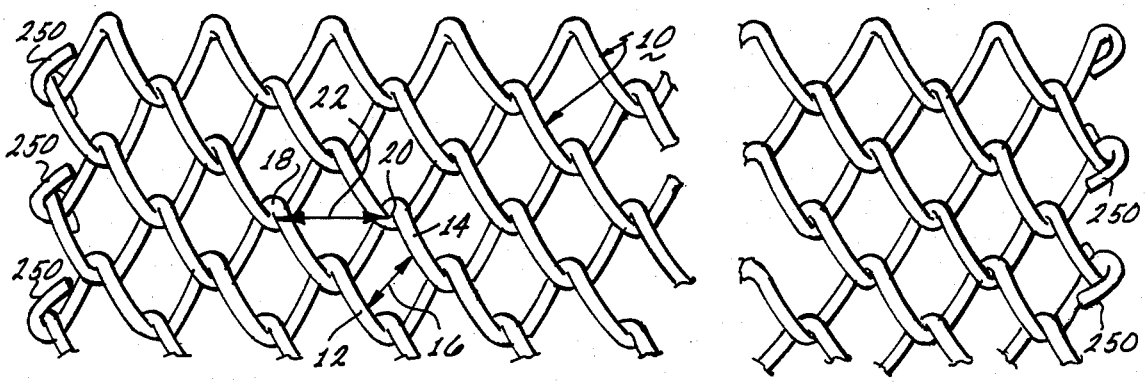
FIG. 1 is an approximately full scale drawing of the security mesh of the present invention produced by the apparatus and method disclosed herein.

FIG. 1 illustrates in substantially full scale, a wire fabric forming a security mesh 10 of the present invention. In general, the security mesh 10 is formed of relatively heavy gauge wire such as 9 to 14 gauge wire which would normally be woven into wire fabric of a substantially larger size. In particular, wire of the gauge used to form the security mesh 10 of the present invention would normally be used to form wire fabric with openings considerable larger, such as two (2) or more times as large as the openings present in the security mesh 10.

As an example, the security mesh 10 may have openings of approximately three-eighths ($\frac{3}{8}$) of an inch when measured on a diagonal between adjacent links such as links 12 and 14. This measurement may be seen by the arrow 16. In addition, the distance between peak points in adjacent loops in the same length of coiled wire may be approximately three-quarters ($\frac{3}{4}$) of an inch such as between adjacent peak points 18 and 20 as shown by the arrow 22. The present invention provides for an apparatus and method for automatically making and finishing wire fabric of the small size and heavy gauge wire of the type shown by the security mesh 10 of FIG. 1.

Figure 2A:
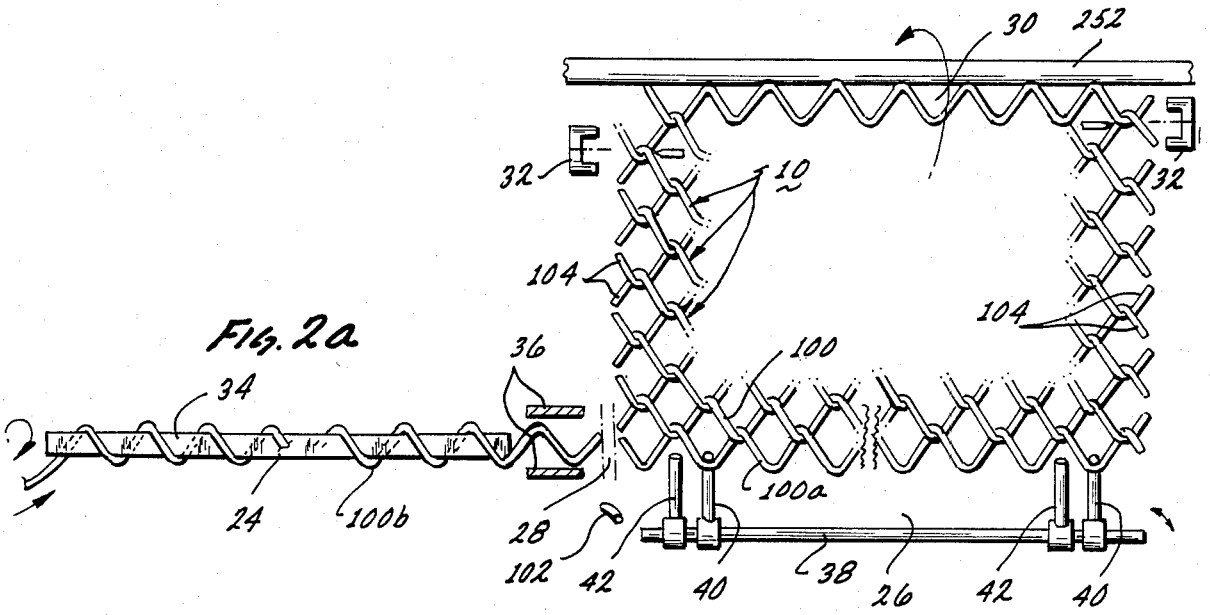
FIGS. 2*a*, 2*b*, 2*c*, 2*d*, and 2*e* illustrate the operation of the method and apparatus for producing the security mesh of the present invention.

FIGS. 2*a* through 2*e* illustrate in progressive steps the apparatus and method of making the security mesh of the present invention. As shown in FIG. 2*a*, the apparatus for making the security mesh 10 includes a coiling station 24, a weaving station 26, a cutting station 28, a take-up station 30, and knuckling stations 32.

As shown in FIGS. 2*a* through 2*e* the security mesh 30 is formed of a plurality of individual lengths of coiled wire 100. The coiling of the wire to form the individual lengths of coiled wire 100 is accomplished at the coiling station 24 wherein the wire is coiled around and rotated by a bar 34. The coiled wire passes through guides 36 to be interwoven onto the last length of coiled wire and as shown in FIG. 2 the last length of coiled wire is designated 100(*a*). The weaving of the wire is accomplished at the weaving station 26, and the individual lengths of coiled wire 100 are held in position for weaving by the use of rod member 38, which supports a plurality of fingers 40 facing in one direction, and a second plurality of fingers 42 facing in the other direction.

The rod member 38 is rocked back and forth so that the fingers 40 and 42 alternately engage successive lengths of coiled wire 100 after weaving. As shown in FIG. 2*a*, the fingers 40 are engaging the last length of coiled wire 100(*a*). This last woven length of coiled wire 100(*a*) is formed by cutting out a small portion 102 of the wire at the cutting station 28. The cutting out of the portion 102 severes the length 100(*a*) of coiled wire from a next length 100(*b*) of coiled wire.

As can been seen in FIG. 2*a*, the portion 102 of wire which is cut out represents a small portion at a peak point of a loop of the wire so as to allow for cut ends 104 greater than one-half ($\frac{1}{2}$) the distance between successive peak points in the coiled wire. Normally, in the manufacture of prior art wire fabric, the wire is cut midway between the successive peak points. However, the present invention provides for the lengths of the cut ends 104 to be greater than one-half ($\frac{1}{2}$) of the distance between successive peak points so as to insure that a sufficiently long length of cut end exists so to provide for these ends being properly knuckled over. The knuckling is provided at the knuckling station 32 or if desired the cut ends have sufficient length to be formed into barbed ends. Because of the small size openings of the security mesh 10 of the present invention, cutting the wire at the normal position halfway between successive peak points would not allow for a sufficiently long cut end 104 to properly lock the end portions of the security mesh.

Figure 2B:
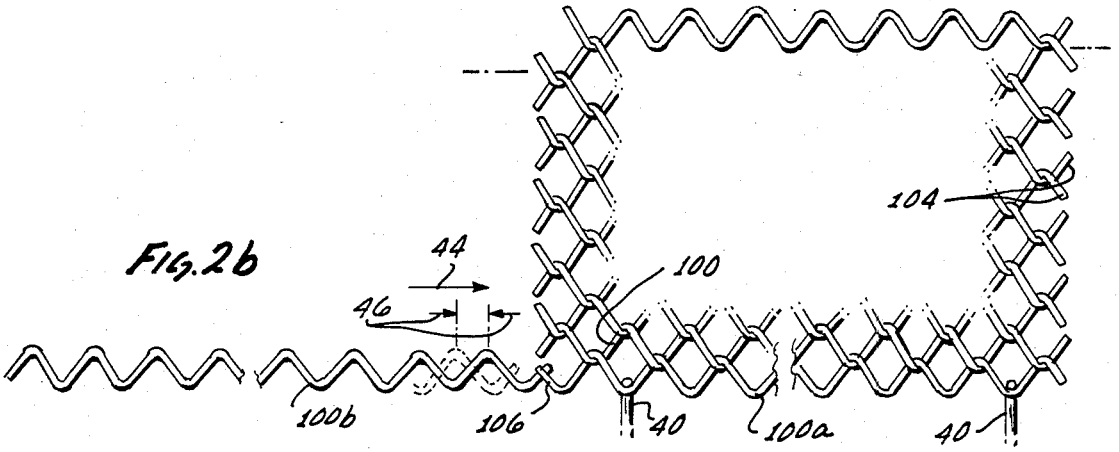

The small portion 102 is cut-out to separate the length 100(*a*) from the next length 100(*b*) of wire. It is now necessary to move the length 100(*b*) of wire into position for interweaving with the length 100(*a*) of wire. This is accomplished as shown in FIG. 2*b* by moving the coiled length 100(*b*) forward a distance represented by a phase shift of approximately 180°. This movement is shown in FIG. 2*b* by the arrow 44 and with the distance shown by the spacing defined by the arrows 46. As can be seen in FIG. 2*b*, the adjacent ends 104 of the lengths 100(*a*) and 100(*b*) of wire now overlap at position 106. The coiled length 100(*b*) may now be rotated to interweave with the coiled length 100(*a*) and the coiled lengths will properly interweave because of the proper orientation between the end portions at the overlapped position 106.

Figure 2C:
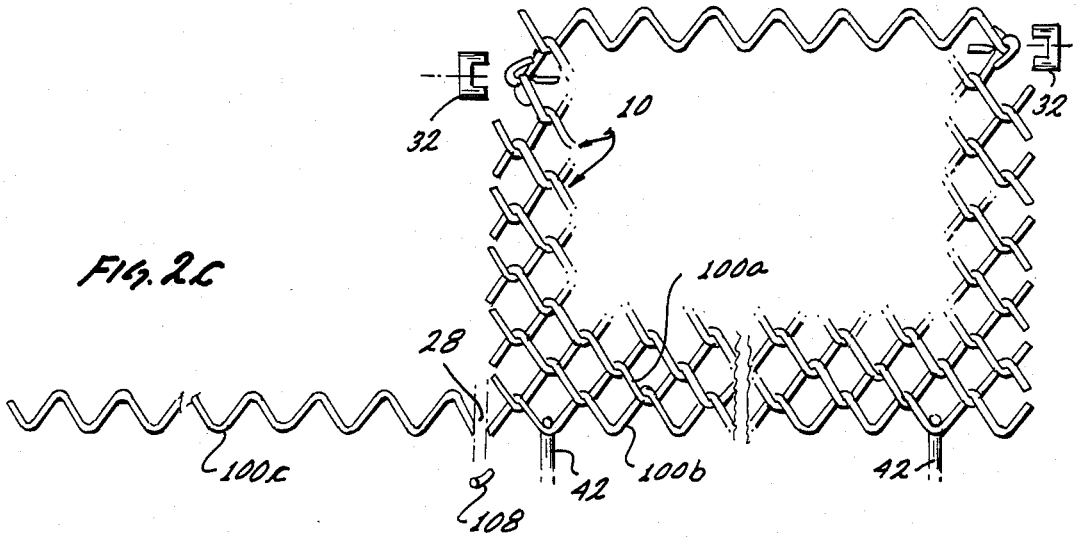
Figure 2D:
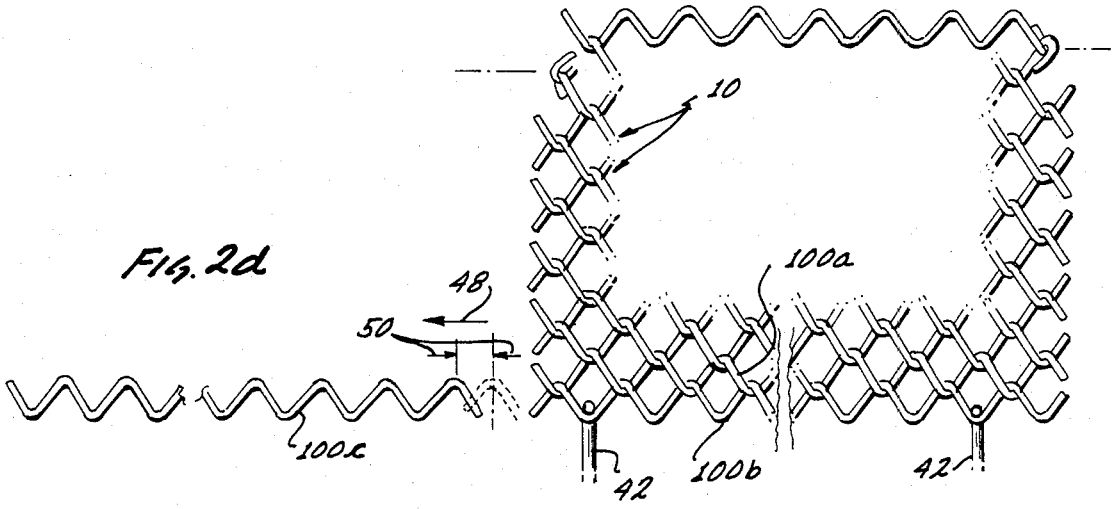

FIG. 2*c* illustrates the coiled length 100(*b*) of wire completely interwoven to now form the last woven length of the security mesh 10 and with this length held in position by arms 42. At this time, the cutting station 28 provides for a small portion 108 of wire to be removed. The portion 108 is similar to portion 102 shown in FIG. 2*a* except in FIG. 2*a* the portion 102 is from an upper peak point whereas in FIG. 2*c* the portion 108 is from a lower peak point. The remaining coiled length 100(*c*)of wire is now moved backward as shown in FIG. 2*d* by arrow 48. The coiled length 100(*c*) of wire is moved backwards by a distance approximatley represented by a 180° phase shift and the distance is shown by the distance between the arrows 50.

Figure 2E:
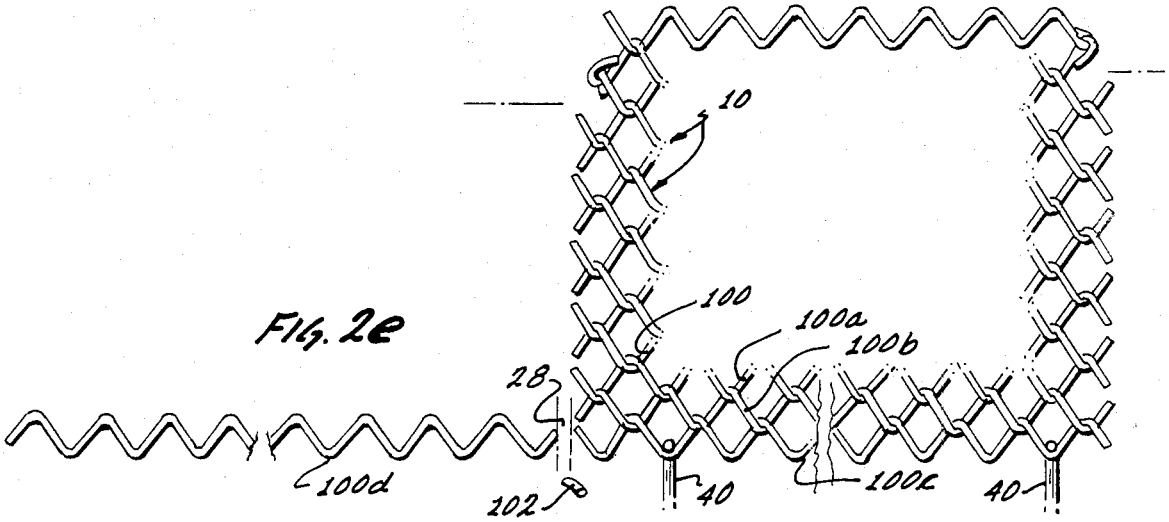

When the length of coiled wire 100(*c*) is moved back as shown in FIG. 2*d* the adjacent ends of the wire length 100(*c*) and the wire 100(*b*) now have the proper orientation to allow the wires to be properly interwoven as shown in FIG. 2*e*. In FIG. 2*e* the operation of the present invention has gone through a complete cycle and the relationship of the coiled lengths of wire shown in FIG. 2*e* is the same as that shown in FIG. 2*a*. A new length 100(*d*) of coiled wire is now ready for interweaving once the small portion 102 is removed by cutting station 28, and the length is moved forward to the position shown in FIG. 2*b*.

The present invention therefore provides for single lengths of coiled wire to be interwoven to form a security mesh and with small portions of wire removed after each step in the weaving and with the lengths of wire moved alternately forward and backward by a predetermined distance prior to weaving so that the lengths of wire for weaving have the proper spacial relationship with the last interwoven length of wire. The cut-out portions of wire are relatively small to allow for cut ends having a length sufficient for knuckling or barbing. If the wires were cut at the normal middle position, the cut ends would not be sufficiently long. In addition, if the wires were not moved forward and backward the wires would not properly interweaved since the rotating wire would enter the last woven wire at an improper position and could jam.

Figure 3:
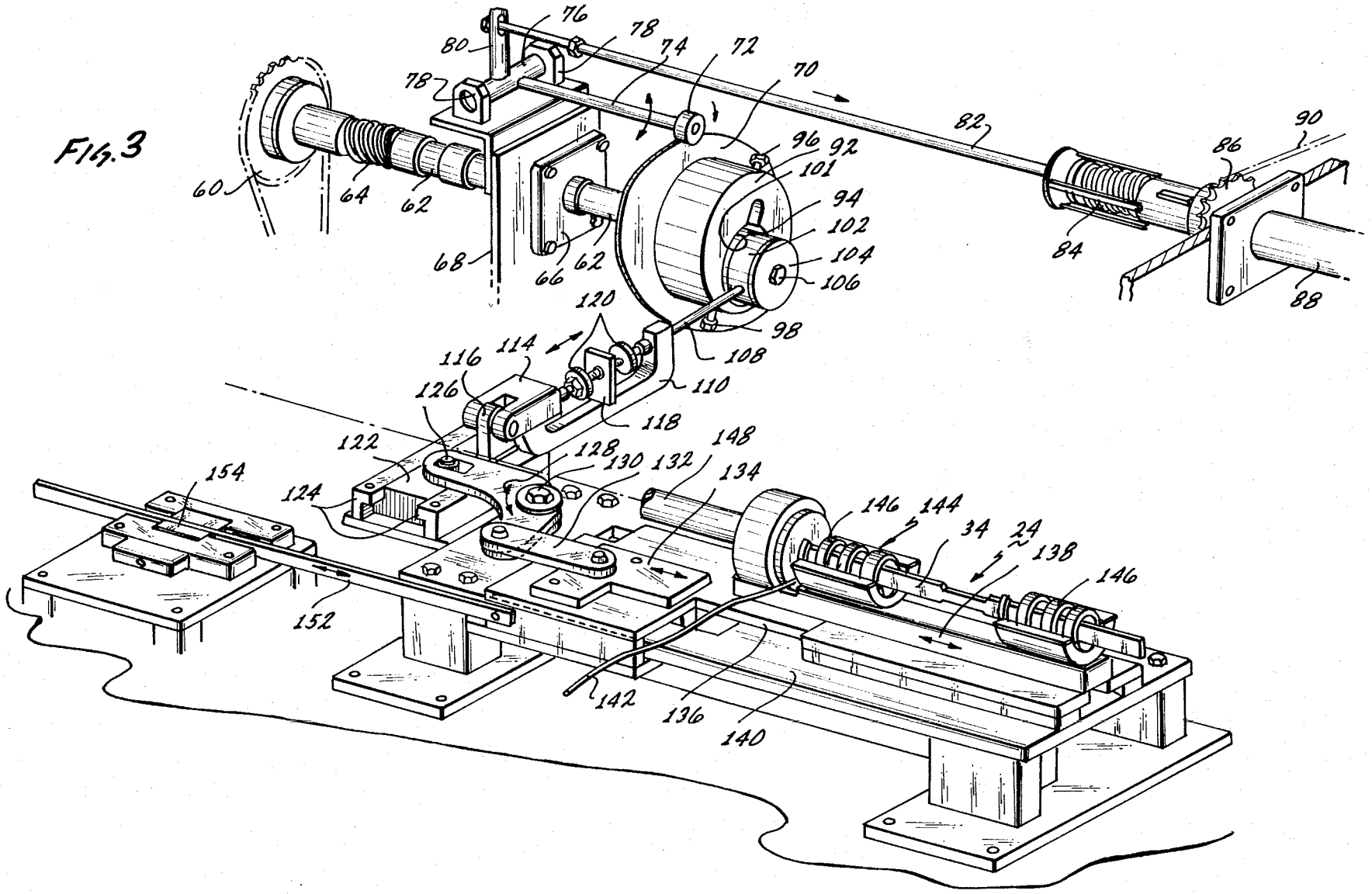
FIG. 3 is a prespective view of the coiling and shifting mechanism of the apparatus of the present invention.
Figure 4:
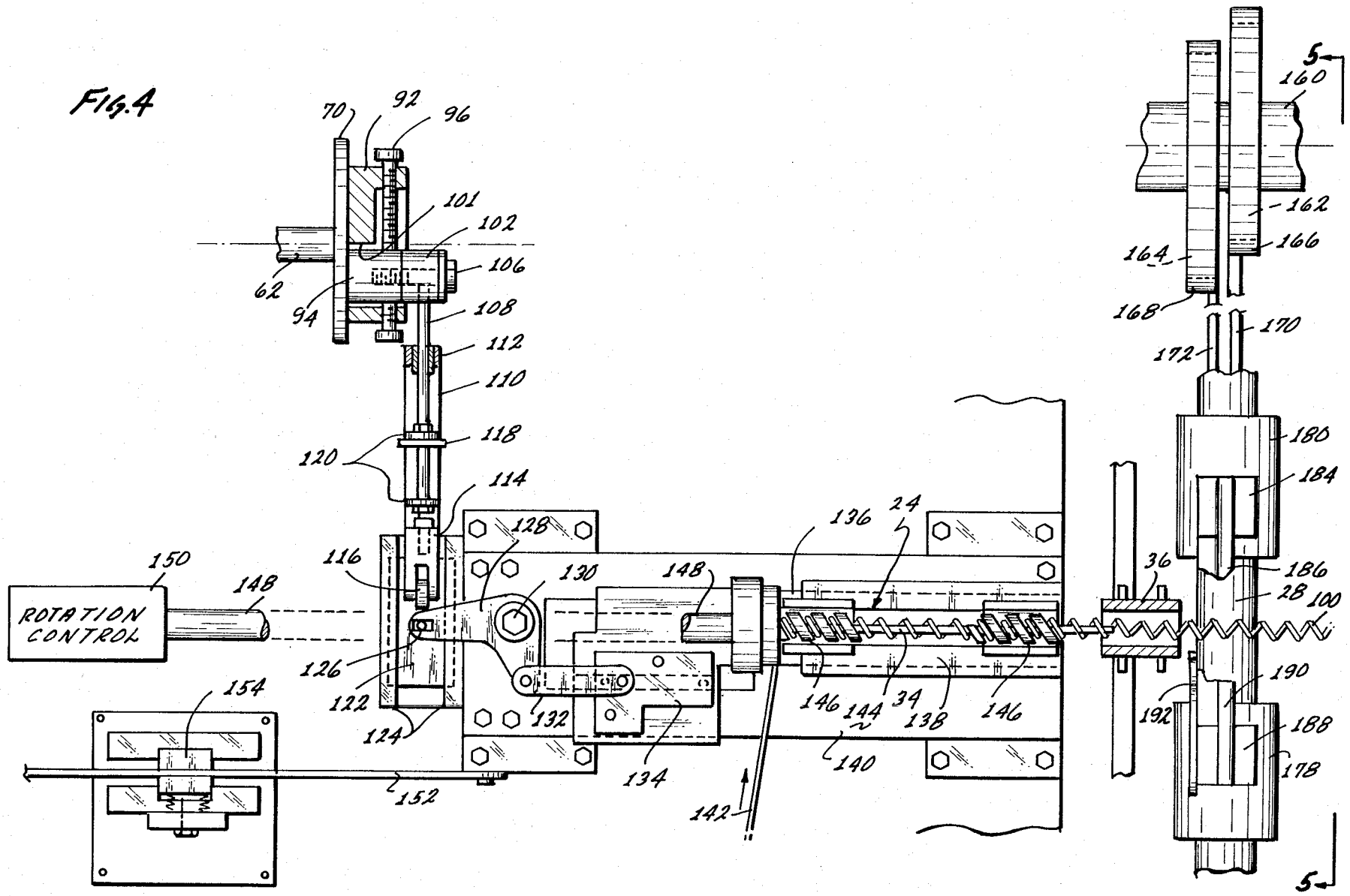
FIG. 4 is a top view of the coiling and shifting mechanism of the apparatus of the present invention and further showing the cutter mechanism.

FIGS. 3 and 4 illustrate in greater detail the coiling mechanism including the structure for providing for the shift of the coiled lengths forward and backwards. A main drive 60 provides rotational movement of a shaft member 62. The main drive 60 may be engaged or disengaged from the shaft 62 by a clutch mechanism 64. The shaft 62 passes through a bearing structure 66 supported on a frame member 68.

At the end of the shaft 62, a double cam structure is supported for rotation to actuate different portions of the apparatus of the present invention. In particular, a first cam plate 70 is mounted for rotation at the end of the shaft 62. The cam plate 70 has a particular cam profile and with a follower member 72 formed as a roller at the end of a shaft 74 following the profile of the cam plate 70. As the follower 72 follows the profile the shaft 74 moves up and down since the shaft 74 is connected to member 76 and the member 76 is held for rotational movement by bearings 78. An arm member 80 extends upwardly from the member 76 and a rod 82 extends outwardly from the arm 80.

It can be seen that as the shaft 74 moves up and down, in accordance with the follower 72 following the profile of the cam plate 80, the rod 82 moves back and forth in synchronism. A clutch mechanism 84 is attached to the end of the rod 82 and the movement of the rod 82 provides for the clutch 84 being in and out of engagement. The actuation of the clutch mechanism 84 also provides for the actuation of a sprocket wheel 86 to produce rotational movement of a shaft 88. The sprocket wheel 86 normally receives power from a drive through a chain link 90 but this power is not transmitted to the shaft 88 until the clutch 84 is engaged.

The rotational movement of the shaft 88 maybe used to drive other portions of the apparatus of the present invention such as a knuckler assembly shown in FIGS. 10 through 15. In addition, the movement of the shaft 88 may also provide for the drive of the cut-out of the small portion 102 by the cutting mechanism shown in FIGS. 5 through 9.

Mounted on the first cam plate 70 is a support housing 92. The housing 92 rotates in accordance with the rotation of the plate 70. The housing 92 supports a second caming structure which includes an adjustable stud 94. In particular, the screw members 96 and 98 lock the stud 94 in position and adjustment of screw members 96 and 98 can provide for adjustment of the position of the stud 94 within an opening 101 in the housing 92.

A cam follower 102 is mounted for rotation on the stud 94. In particular, the cam follower 102 is sandwiched between the stud 94 and a collar 104 and with a bolt member 106 having a threaded end portion, as shown in FIG. 4, threaded into the stud 94. The cam follower 102 therefore is free to rotate on the unthreaded portion of the bolt 106 as the entire cam mechanism is rotated in accordance with a rotation of the shaft 62. A rod member 108 extends from and is affixed to the follower 102. As the cam mechanism is rotated the rod member 108 moves in and out with also a small up and down movement, so that the rotational movement of the cam mechanism is translated to a substantial linear movement of the rod member 108.

The rod member 108 is coupled to a linkage having a delay action. In particular, the linkage includes a U-shaped member 110 which receives and guides the rod member 108 in a bearing assembly 112. The U-shaped member 110 includes a pivot coupling 114 and with the pivot coupling 114 pivotally attached to an upstanding tab 116. The U-shaped member 110 also includes an upstanding flange 118 which flange 118 includes an opening to allow the passage of the rod 108. The rod member 108 also includes pads 120 mounted to be located on either side of the flange 118.

As the rod member moves back and forth the pads alternately engage the flange 118 to provide for similar back and forth movement of the U-shaped member 110. Because the pads 120 are spaced apart, this provides a built-in delay in both directions of movement before the pads engage flange 118. Even though the movement of the rod member 108 is continuous first in one direction and then the other, the movement of the U-shaped member 110 is confined to small periods during the continuous movement of the rod member 108 when the pads alternately engage the flange 118. The pivotable coupling between the U-shaped member and the upstanding tab 116 accomodates the small up and down motion of the rod member 108.

The upstanding tab 116 extends from a slide member 122 which slide member 122 is retained in a guide structure 124. The rotatable motion of the shaft 62 is therefore translated through the cam mechanism including the follower 102 into a precise linear movement of the slide 122 for short predetermined periods during the rotational cycle of the shaft 62.

A pin 126 extends upwardly from the slide 122. The pin 126 is received within a slot at one end of an L-shaped member 128. The L-shaped member 128 pivots around a fixed pivot point 130. A link 132 extends from the L-shaped member 128 and with one end of the link 132 pivotally attached to the L-shaped member 128 and the other end of the link 132 pivotally attached to a plate 134. The plate 134 is affixed to a large slidable support plate 136 for the coiling station 34. In particular the various portions of the coiling station 34 are mounted for rotation on a support member 138 and with a support member 138 in turn directly mounted on the support plate 136. The support plate 136 is mounted in sliding relation to a bed 140 so as the support plate 136 is slid, this carries the member 138 and the coiling station 24.

The rotational motion of the shaft 62 is thereby converted to an intermittent linear motion of the coiling station 24 through the the use of the caming mechanism including the cam follower 102 driving the U-shaped member 110 and with the intermittent motion of the the U-shaped member 110 transferred through the various linkages including the slide member 122, the L-shaped member 128 and the link 132 which is attached to the plate 134 mounted to the main mounting plate 136. As indicated above, the main mounting plate 136 supports the support member 138 which in turn has the coiling station 24 mounted on the support 138. The entire structure slides intermittently to provide the forward and backward movement of coiling station 24 relative to the mounting bed 140 as shown in FIGS. **2*b* and 2*d***.

The coiling station 24 provides for the coiling of wire 142, by a rotatable coiling head 144, which includes the rotatable bar 34 and coiling guides 146. The bar 34 is mounted at the end of a shaft 148 and is controlled for rotation by a rotation control 150. Coiling station 24 provides for coiling of the straight wire 142 into lengths of coiled wire 100 as shown in FIGS. **2*a* through 2*e***.

In order to insure that the forward and backward motion of the coiling station 24 is operating properly, a flat rod 152 is mounted to the slidable mounting plate 136. The rod 152 has one end passing through a sensor mechanism 154. This sensor mechanism may be of any appropriate type such as an optical sensor or a mechanical sensor such as a pressure sensor and if the rod is not moving within the sensor in a straight back and forth movement the sensor will detect this improper movement of the rod 152. The sensor will provide an output signal to either give an output warning or to stop the operation of the automatic weaving machine of the present invention.

As shown in FIG. 4 the coiled length of wire 100 also passes through a guide station 36 and a cutting station 28. At the appropriate times as shown in FIGS. *2a, 2c* and *2e,* the cutting station 28 provides for the cutting out of a small portion of the coiled wire so that the length of coiled wire 100 may be properly interwoven to form the security mesh 10 and with the cut ends 104 of the security mesh 10 having sufficient length to allow for a proper knuckling or barbing.

Figures 5, 6, 7, 8, 9:
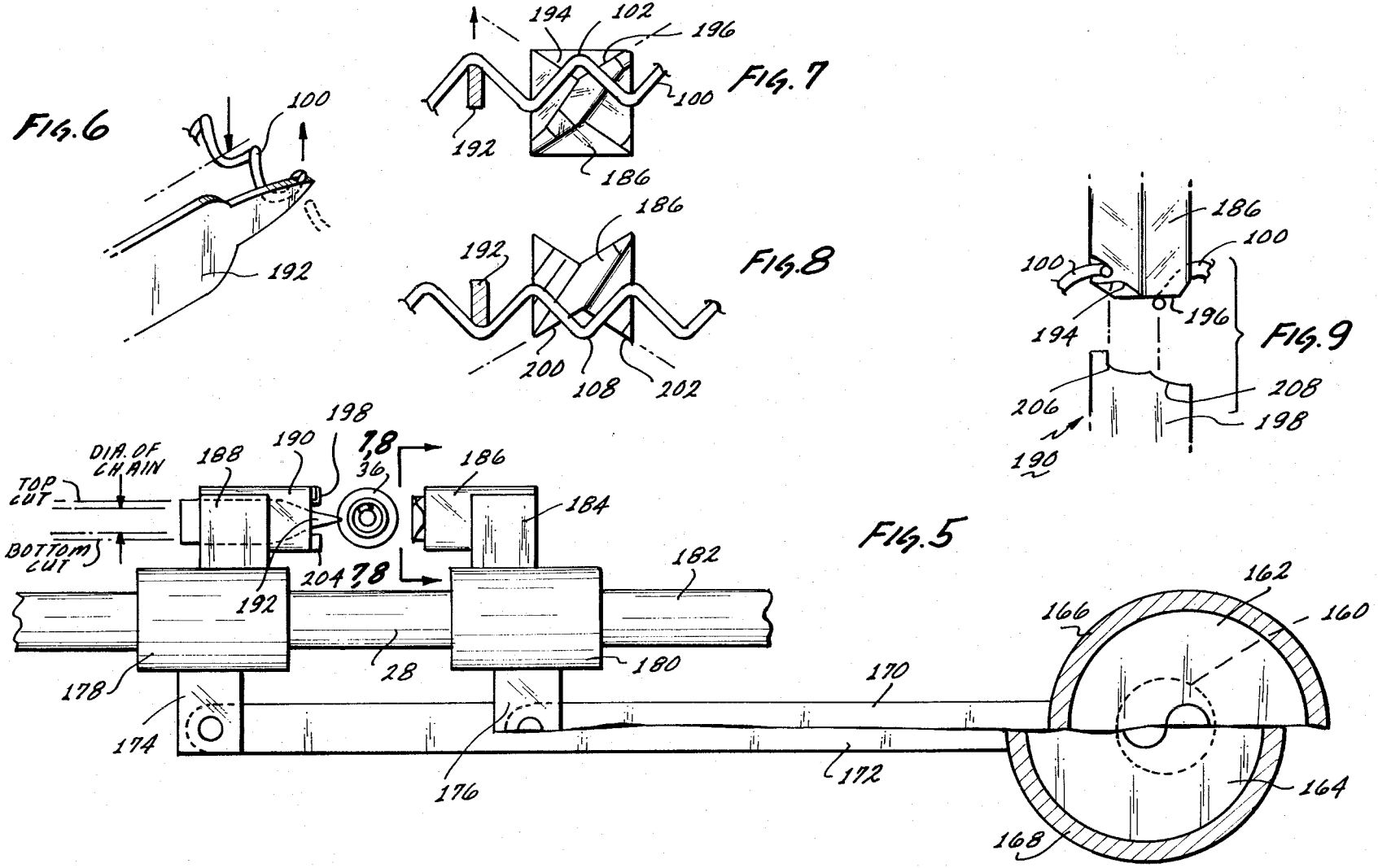
FIG. 5 is an end view of the cutter mechanism taken along lines 5—5 of FIG. 4.
FIG. 6 is a detailed view of a pusher member used as part of the cutter mechanism.
FIGS. 7 and 8 are detailed views of the cutter mechanism taken along lines 7—7 and 8—8 of FIG. 5 and showing the cutting of an upper small portion of the wire loop and a lower small portion of the wire loop.
FIG. 9 is a detailed top view of a portion of the cutter mechanism.

FIGS. 5 through 9 show in greater detail the structure of the cutting station for providing for the cutting of the small portions 102 and 108 from the lengths of coiled wire 100. As shown in FIG. 5, a shaft 160 supports a pair of disks 162 and 164. The shaft 160 may be driven intermittently to have rotations at particular times such as from the shaft 88 shown in FIG. 3. It can be seen that the disks 162 and 164 are mounted eccentrically on the shaft 160. The disks 162 and 164 are positioned respectively within cylindrical members 166 and 168. Rods 170 and 172 are attached to and stand outwardly from the cylindrical members 166 and 168. The rods 170 and 172 are connected to arm members 174 and 176 which extend from slides 178 and 180. The slides are mounted on a common bar 182 so that both slides 178 and 180 slide along the same axis. As the shaft 160 rotates the slides 178 and 180 moves simultaneously in opposite directions to come together to provide a cutting action to remove the small portions 102 and 108 from the lengths of coiled wire 100, and to separate while the next length of coiled wire is interwoven with the last length of coiled wire to form part of the wire fabric 10.

As shown in FIG. 5, a tool holder 184 extends upwardly from the slide 180 and with the tool holder 184 receiving and supporting a cutter 186. A second tool holder 188 extends upwardly from the slide 178 and with a second cutter 190 supported by the tool holder 188. In addition to the cutter 190, a pusher member 192 is also supported by the tool holder 188 and is located to the side of the cutters 192. The may be seen in FIG. 4 and also in FIGS. 7 and 8.

The cutter head 186 has top and bottom cutting surfaces. Specifically, as shown in FIG. 5 and 7, cutting surfaces 194 and 196 act in combination with companion cutting surfaces 198 to remove the small portion 102 at an upper loop peak point of the length of coiled wire 100. As shown in FIGS. 5 and 8, bottom cutting surfaces 200 and 202 operate in conjunction with lower cutting surfaces 204 to remove the portion 108 located at the bottom loop peak point of the length of coiled wire 100. The upper and lower cutting surfaces 198 and 204 are shown in FIG. 5 and in addition, the dotted lines in FIGS. 7 and 8 represent these cutting surfaces.

FIG. 9 also illustrates a top view of the cutters 186 and 190 showing how the cutters accomodate the coiled configuration of the lengths of coiled wire 100. It is to be appreciated that the cutting surfaces 194 and 196 conform to the undulations of the lengths of coiled wire 100. The cutter 190 and specifically, the upper portion 198, as shown in FIG. 9, includes complementary cutting surfaces 206 and 208 to provide for smooth perpendicular cuts of the small portion 102 as shown by the dotted lines in FIG. 7. The bottom cutter portion 204 of the cutter 190, has similar dual cutting surfaces to produce the perpendicular cuts of the small portion 108 as shown by the dotted lines in FIG. 8.

In order to insure that the cutters 186 and 190 produce proper cuts of small portions 102 and 108 at the upper and lower loop peak points, pusher member 192 engages alternately an upper loop portion and a lower loop portion as shown in FIGS. 6, 7 and 8, so as to maintain the length of coiled wire 100 either in the upper or lower position when the cutting action occurs. The pusher 192 may actually push the length of coiled wire 100 alternately upward and downward a very small amount so as to insure the proper cutting action. For example, if the pusher 192 where not used, the cutters might simultaneously remove the small portions 102 or 198 and other portions of the length of coiled wire 100, such as from the opposite loop portion. It should be appreciated however, that although the pusher 192 facilitates the cutting operation and insures the proper cutting, the cutter station 28 could be operated satisfactorily without the pusher 192.

FIGS. 10 through 15 illustrate a particular knuckler assembly for use with the apparatus and method of the present invention. In particular, the normal knuckling terret for standard chain link fencing provides for the cut ends to be bent over in a relatively straight line. Also, since a normal chain link fencing has a relatively open weave structure, the length of cut end available for knuckling is quite long. With the security mesh of the present invention the cut ends are left as long as possible but in order to insure a proper knuckling the cut ends must not only bent over but also twisted so that the cut ends are folded securely in position to interlock the end portions of the security mesh 10. The knuckled ends are designated by reference numeral 250 as shown in FIG. 1 and with knuckling stations 32 positioned adjacent the cut ends 104 to provide knuckling on both end portions of the security mesh as shown in FIG. *2a.*

FIGS. 10 through 15 illustrate the structure and operation of a single knuckler 32 but is to be appreciated that two (2) such knucklers may be used, one on each side of the security mesh. The knuckler assembly 32 would be mounted adjacent a guide shaft 252 as shown in schematic form in FIG. *2a* and shown in more detail in FIGS. 10 and 15. The guide shaft is mounted using mounting structure 254 and a portion of the mounting structure may be used to support a mounting assembly 256 which assembly includes a mount 258 which serves as an upper mount for the knuckler assembly.

Figure 10:
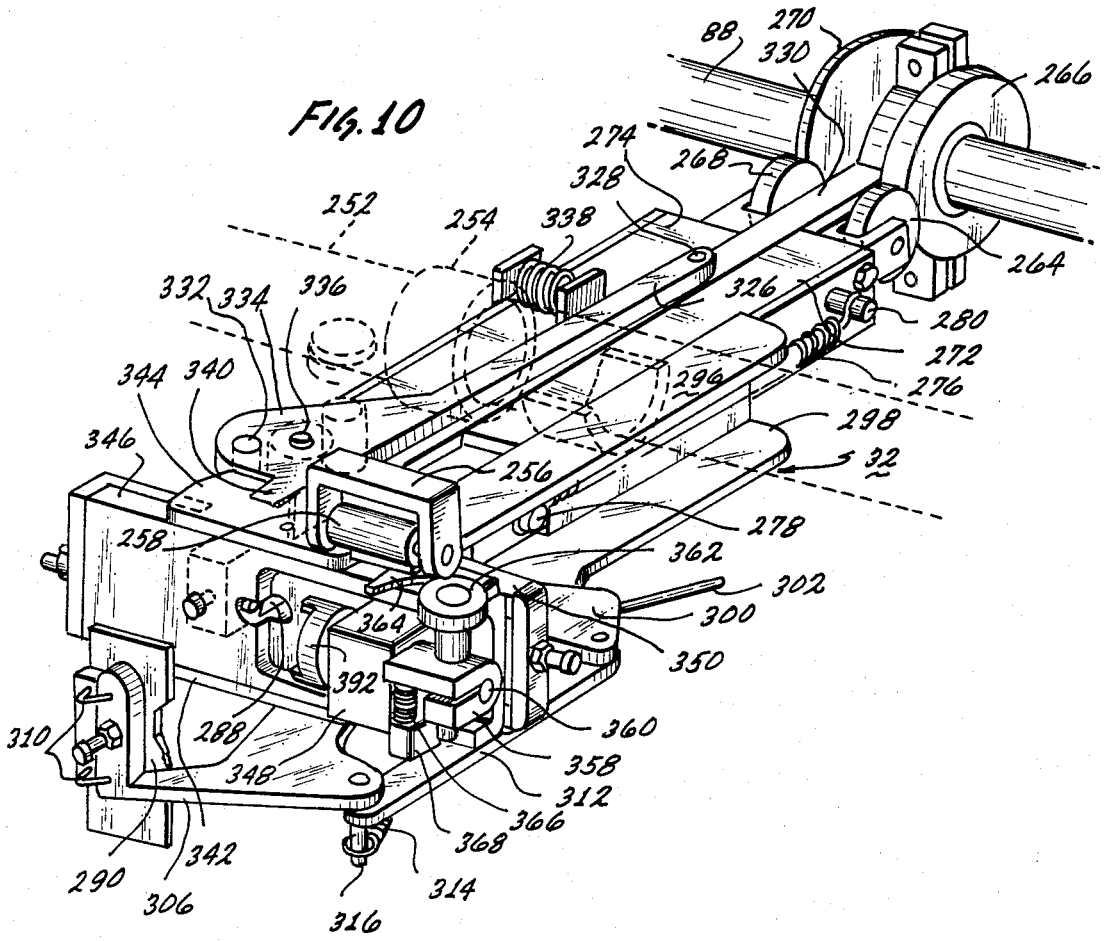
FIG. 10 is a perspective view of a knuckler assembly for interlocking the cut ends of the security mesh.
Figure 13:
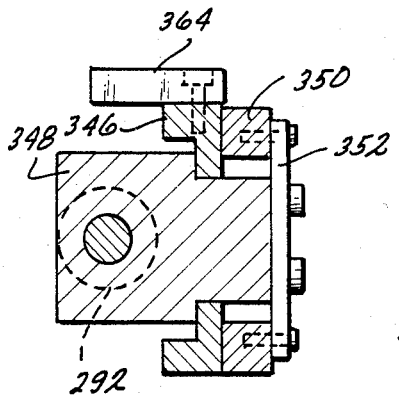
FIG. 13 is a cross sectional view of the knuckler taken along lines 13-13 of FIG. 11.

The knuckler assembly actually includes two (2) cam actuated sliding members; specifically, a first sliding member 260 and a second sliding member 262. A roller 264 is mounted at one end of the sliding member 260 and with the roller 264 actuated by a cam member 266 mounted on the shaft 88 shown in FIG. 3. A roller member 268 is mounted on the sliding member 262 and is actuated by a cam member 270 also mounted on the shaft 88. As can be seen in FIGS. 10, 11 and 12, as the shaft 88 rotates, this provides rotation of the cams 266 and 270 which in turn provides for sliding motion of the sliding members 260 and 262.

The sliding members 260 and 262 are captured within guides 272 and 274 so as to confine the sliding members 260 and 262 to a linear motion. The sliding member 260 is generally urged in a direction towards the shaft 88 by a spring 276 which spring is coupled between a post 278 extending from the sliding member and a post 280 affixed to the guide structure 272. Similarly, the sliding member 262 is urged in a direction toward the shaft 88 by a spring 282 which is mounted between a post 284 extending from the sliding member and a post 286 mounted on the guide structure 274.

The slide member 260 operates knuckler backup structure including a backup blade 288 which blade 288 operates in conjunction with a fixed backup plate 290. The slide member 262 actuates the knuckling head 292. The backup blade 288 is directly connected to slide member 260 and operates directly from the motion of the slide member 260 as shown by the two (2) extreme positions of operation of the slide member in FIG. 11 and 12. The knuckling head 292 is operated through the use of intermediate linkages and with the two (2) extreme positions of operation of the knuckling head shown in FIGS. 11 and 12.

Figure 15:
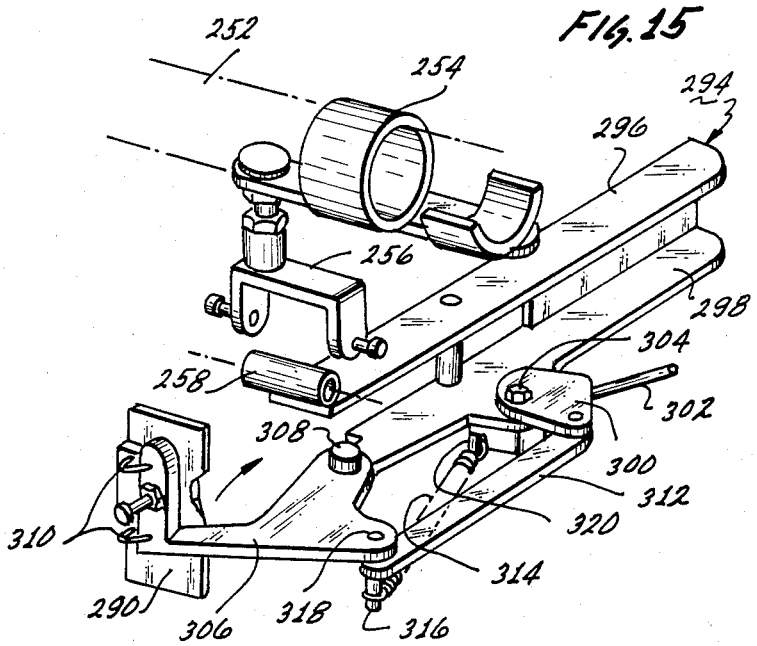

FIG. 15 illustrates in detail the operation of mechanism to actuate the backup plate 290 between one of two fixed positions. As shown in FIG. 15, a U-shaped mounting structure 294 is fixedly coupled to the slide housing 272 as shown in FIG. 10. The upper portion of the U-shaped member 294 serves as support for the mounting assembly 254 and in particular the mount 258 is attached to the upper plate so that the knuckler assembly 32 may be attached to the mounting structure for the guide bar 252. The U-shaped member 294 also includes a lower plate 298 opposite the upper plate 296. The lower plate includes a linkage to swivel the backup plate 290 into or out of engagement with the security mesh. In particular, a rotatable plate 300 with an extending manual arm 302 is pivotably mounted to the lower plate 298 at a pivot point 304. A rotatable arm member 306 is also mounted at the end of the lower plate 298 and pivots around pivot point 308.

The backing plate 290 is flexibly mounted at the end of the arm 306 and in particular, resilient mounting members 310 are included so that the plate 290 has limited flexibility when engaging the security mesh 10. A link member 312 interconnects the arm 306 and the plate 300 so that the manual arm 302 may be moved to provide for the backing plate 290 moving into and out of engagement with the security mesh 10. A spring member 314 interconnects a post 316, which is located along the pivot point 318, and a second post 320, which extends from the lower plate member 298. The spring member 314 has an over center action to maintain the flexible plate 290, either in a position in engagement, or a position out of engagement, in accordance with the movement of the manual arm 302.

The operation of the knuckler head 292 is in accordance with movement of the slide member 262. Specifically, the slide member 262 includes a cam surface 322 at its outer end. A pair of swinging arms including arm 324 shown in FIG. 11 and arm 326 shown in FIG. 12 pivot from pivot point 328 on fixed member 330 and are pinned together by pin member 332. The arm members 324 and 326 support a cam roller 334 which roller is positioned on shaft 336 which extends between the arm members 324 and 326. As shown in FIGS. 10 and 12, a spring member 338 normally urges the arm members 324 and 326 in the direction shown by the position of the arm members in FIG. 11.

When the slide member 262 is moved from the position shown in FIG. 11 to the position shown in FIG. 12, by the operation of the cam 270 and the cam follower 268, the roller member 334 is moved up along the cam profile 322 so that the arm members 324 and 326 are moved to the position shown in FIG. 12. The arm members 324 and 326 include end portions 338 and 340 which engage slots in slide members 342 and 344. The slide members 342 and 344 slide relative to a fixed sliding surface 346. The slide members 342 and 346 also support the knuckler head 292 since the knuckler head 292 is supported for rotation by a block member 348 and the block member in turn is mounted to the slide members 242 and 244 by the use of frame structure 350 and plate 352. The sliding members 342 and 344, and frame members 350 and 352 and block member 348, which supports the knuckler head 292, all move together with sliding motion from the position shown in FIG. 11 to the position shown in FIG. 12 so that the knuckler head 292 is moved into engagement with the cut ends 104 of the security mesh 10.

In order to insure that the cut ends 104 are properly knuckled over, the knuckler head 292 is not only moved into engagement with the cut ends, but also the knuckler head is rotated to both fold over and rotate the cut ends so as to produce the knuckled ends 250. As shown in FIG. 14*a* and 14*b*, the knuckler head 292 includes upstanding portions 354 and 356 so that the cut ends are captured against the tapered sides of the upstanding portions and with the combination of rotary and linear movement bending and rotating the cut ends over and inward to produce the knuckled ends 250.

The simultaneous rotary and linear motion of the knuckler head 292 is produced by a structure including a U-shaped member 358. The member 358 mounts on and captures a shaft member 360, which shaft member 360, supports the knuckler head 292. A rotatable cam follower 362 extends from the U-shaped member 358 and with the cam follower 362 following the profile of a cam member 364 mounted on the fixed mounting block 346. A spring member 366 extends between the U-shaped member 358 and a fixed portion 368 mounted to the block 348. The The spring member 366 tends to urge the U-shaped member to the position shown in FIGS. 10 and 11.

As the block 348 is moved from the position shown in FIG. 11 to the position shown in FIG. 12, the cam follower 362 rolls up against the caming surface of the cam member 364. The U-shaped member 358 is thereby rotated in the direction shown by the arrow shown in FIG. 11 and 14*b* due to the action of the cam follower 362 against the caming surface of the cam member 364. The knuckler head 292 is thereby rotated at the same time as the head is moved into engagement with the cut ends 104 to both twist and fold over the cut ends to produce the knuckled ends 250.

The present invention therefore provides for the automatic weaving of a security mesh wire fabric having a small opening in the fabric relative to the gauge of the wire used in the fabric. The automatic weaving of the security mesh is accomplished by coiling single lengths of the wire and weaving these single lengths together to form the security mesh. Each time a single length is woven into the security mesh, a cutting station removes a small portion of coiled wire to leave cut ends of sufficient length so that the cut ends may be knuckled over. In order to insure the proper weaving of the individual lengths, each length prior to weaving is either moved forward or alternately backward by a fixed distance equal to approximately the distance between the peaks of adjacent loops, so that the relationship between the adjacent cut ends produces the proper overlap to provide for the proper interweaving. The apparatus and method of the present invention also includes a knuckler assembly which provides for folding back and rotating the cut ends so as to securely interlock the cut ends.

Although the present invention has been described with reference to a particular embodiment, it is to be appreciated that various adaptations and modifications may be made and the invention is only to be limited by the appended claims.

I claim:

1. An apparatus for processing wire to produce a wire fabric of open construction and with the wire fabric formed with small openings relative to the gauge of the wire so as to form a security mesh, including, coiling means for coiling the wire to have small loops, cutting means positioned adjacent the coiling means for cutting the coiled wire into individual lengths, weaving means positioned adjacent the cutting means for repetitively interweaving the coiled wire before the coiled wire is cut with the coiled wire lastly cut to form the security mesh with the interweaving operation of one individual length of coiled wire at a time, the cutting means cutting the coiled wire into individual lengths by cutting out a small portion of an individual loop of the coiled wire, and shifting means coupled to the coiled wire for alternately shifting the coiled wire forward and backward for successive interweaving operations for providing the proper orientation for interweaving between the lengths of coiled wire before each interweaving operation.

2. The apparatus of claim 1 wherein the cutting means cuts out the small portion at a peak point of the individual loop of the coiled wire to provide for the cut ends having lengths greater than one half ($\frac{1}{2}$) the distance between successive loops of the coiled wire.

3. The apparatus of claim 2 wherein the cutting means cuts out the small portion after successive interweaving operations alternately at top and bottom peak points.

4. The apparatus of claim 1 wherein the cutting means includes at least one cutting tool having two spaced cutting edges for simultaneously making two cuts for cutting out the small portion.

5. The apparatus of claim 1 wherein the cutting means includes two cutting tools located on opposite sides of the coiled wire and including means for moving the cutting tools toward each other for cutting out the small portion.

6. The apparatus of claim 1 wherein the shifting means provides shifting of the coiled wire forward and backward by a distance represented approximately by a phase shift of 180° of the coiled wire.

7. The apparatus of claim 1 wherein the shifting means is coupled to the coiling means and provides shifting of the coiling means to produce shifting of the coiled wire.

8. The apparatus of claim 1 additionally including means for knuckling over the cut ends of the security mesh by both folding and twisting the cut ends.

9. The apparatus of claim 8 wherein the means for knuckling includes a knuckling head having upstanding portions to engage the cut ends and with the knuckling head moved toward the cut ends to fold over the cut ends and with the knuckling head also rotated to twist the cut ends.

10. The apparatus of claim 9 wherein the means for knuckling includes a blade member for insertion within the security mesh behind the cut end to support the cut ends during knuckling.

11. The apparatus of claim 10 wherein the means for knuckling includes a flexible mounted plate member to bear against the security mesh for resisting movement of the security mesh during knuckling.

12. A method of processing wire to produce a wire fabric of open construction and with the wire fabric formed with small openings relative to the gauge of the wire so as to form a security mesh, including the following steps:

coiling the wire to have small loops, cutting the coiled wire into individual lengths by cutting out a small portion of an individual loop of the coiled wire, repetitively interweaving the coiled wire before the coiled wire is cut with the coiled wire lastly cut to form the security mesh with the interweaving operation of one individual length of coiled wire at a time, and alternately shifting the coiled wire forward and backward for successive interweaving operations for providing the proper orientation for interweaving between the lengths of coiled wire before each interweaving operation.

13. The method of claim 12 wherein the step of cutting out the small portion at a peak point of the individual loop of the coiled wire to provide for the cut ends having lengths greater than one half ($\frac{1}{2}$) the distance between successive loops of the coiled wire.

14. The method of claim 13 wherein the step of cutting cuts out the small portion after successive interweaving operations alternately at top and bottom peak points.

15. The method of claim 12 wherein the step of cutting includes providing two spaced cutting edges for simultaneously making two cuts for cutting out the small portion.

16. The method of claim 12 wherein the step of cutting includes providing cutting tools located on opposite sides of the coiled wire and including the step of moving the cutting tools toward each other for cutting out the small portions.

17. The method of claim 12 wherein the step of shifting provides shifting the coiled wire forward and backward by a distance represented approximately by a phase shift of 180° of the coiled wire.

18. The method of claim 12 wherein the step of shifting provides shifting of a means for coiling so as to produce shifting of the coiled wire.

19. The method of claim 12 additionally including the step of knuckling over the cut ends of the security mesh by both folding and twisting the cut ends.

20. The method of claim 19 wherein the step of knuckling includes providing a knuckling head having upstanding portions to engage the cut ends and with the step of knuckling including moving the knuckling head toward the cut ends to fold over the cut ends and rotating the knuckling head to twist the cut ends.

21. The method of claim 20 wherein the step of knuckling includes providing a blade member and inserting the blade member within the security mesh behind the cut end to support the cut ends during knuckling.

22. The method of claim 21 wherein the step of knuckling includes providing a flexible mounted plate member to bear against the security mesh for resisting movement of the security mesh during knuckling.

23. A method of forming security mesh of open construction formed with small openings relative to the gauge of the wire, comprising the steps of:

coiling the wire to have small loops, cutting the coiled wire into individual lenghts by cutting out a small portion of an individual loop of the coiled wire and wherein the cutting out of the small portion is at a peak point of the individual loop of the coiled wire to provide for the cut ends having lengths greater than one half ($\frac{1}{2}$) the distance between successive loops of the coiled wire.

repetitively interweaving the coiled wire before the coiled wire is cut with the coiled wire lastly cut to form the security mesh with interweaving operation of one individual length of coiled wire at a time, and alternatively shifting the coiled wire forward and backward for successive interweaving operations for providing the proper orientation for interweaving between the lengths of coiled wire before each interweaving operation.

24. The method of forming security mesh of claim 23 wherein the cutting out of the small portion after successive interweaving operations is alternatively at top and bottom peak points.

25. The method of forming security mesh of claim 23 wherein the shifting of the coiled wire forward and backward is by a distance represented approximately by a phase shift of 180° of the coiled wire.

26. The method of forming security mesh claim 23 additionally including knuckling over the cut ends of the security mesh by both folding and twisting the cut ends.

* * * * *